US005498131A

United States Patent [19]

Minto

[11] Patent Number: 5,498,131

[45] Date of Patent: Mar. 12, 1996

[54] STEAM TURBINE WITH THERMAL STRESS REDUCTION SYSTEM

[75] Inventor: Karl D. Minto, Ballston Lake, N.Y.

[73] Assignee: General Electric Company, Schenectady, N.Y.

[21] Appl. No.: 398,183

[22] Filed: Mar. 2, 1995

[51] Int. Cl.[6] ..... F01D 19/00

[52] U.S. Cl. ..... 415/216.1; 415/115; 415/177; 60/646; 60/656

[58] Field of Search ..... 415/115, 177, 415/216.1; 416/95; 60/646, 656

[56] References Cited

U.S. PATENT DOCUMENTS

| | | | |
|---|---|---|---|
| 2,883,151 | 4/1959 | Dolida | 415/177 |
| 4,651,532 | 3/1987 | Abe | 60/646 |
| 5,360,318 | 11/1994 | Siga et al. | 415/216.1 |
| 5,433,079 | 7/1995 | Badami et al. | 60/646 |

FOREIGN PATENT DOCUMENTS

| | | | |
|---|---|---|---|
| 49126 | 7/1940 | Netherlands | 416/95 |

*Primary Examiner*—Edward K. Look
*Assistant Examiner*—Michael S. Lee
*Attorney, Agent, or Firm*—Donald S. Ingraham; Marvin Snyder

[57] ABSTRACT

A steam turbine has a rotor-stress reducing steam system coupled to the rotor bore of the rotor shaft so as to introduce steam in the rotor bore. The rotor-stress reducing steam system has a radial steam supply device in which steam is introduced via radial channels through the rotor core, or alternatively, an axial steam supply device has a steam supply tube coaxially disposed within the rotor bore. The surface of the rotor core that is the boundary of the rotor bore typically has rifled grooves so that condensate from the warming steam is collected and directed to a bore condensate drain apparatus coupled to the rotor bore.

12 Claims, 3 Drawing Sheets

STEAM TURBINE WITH THERMAL STRESS REDUCTION SYSTEM

BACKGROUND OF THE INVENTION

Steam turbines are commonly used to drive electrical generators in power plants. A typical steam turbine is a massive yet intricate piece of machinery that must be started up in a controlled manner in order to protect the many turbine components from damage from stresses and distortion that would result from uncontrolled exposure to high temperature and high pressure steam. One part of the turbine startup process is the pre-warming procedure, which includes turbine rotor pre-warming. The rotor core is the massive cylindrical shaft of the turbine to which the steam buckets are attached. The goal of the rotor pre-warming process is to raise rotor core temperatures without exceeding allowable rotor stress limits; after warming, the turbine can be safely accelerated to its nominal operating speed.

Warming of the rotor core is often a limiting factor in the time required to place a turbine in service. In the conventional prewarming process, small amounts of steam are admitted to the high pressure side of the turbine (that is, the turbine blade area) to cause the turbine rotor to warm up, both through direct exposure to the steam and conduction of heat through the metal of the rotor shaft. During the heating process, condensate from the steam admitted to the turbine must be drained off to avoid buildup of liquid in the turbine casing (or shell) and subsequent erosion or cavitation damage to turbine buckets or nozzles. This procedure is continued until the turbine core temperature passes the critical temperature (typically about 350° F.), at which time the turbine is ready to be accelerated and loaded. Cooling of the turbine can present similar problems with respect to inducing thermal stress on the rotor shaft.

It is desirable from an operational standpoint to complete the warm-up or cool down procedures in the shortest time consistent with turbine limitations such as allowable rotor stress. Rapid warm up allows the turbine to be used to meet unplanned short term emergent loads or the like, increasing the efficiency and flexibility of the power generating station of which the steam turbine is a part.

An object of one embodiment of this invention is to provide a steam turbine having a system to reduce thermal stress in warm-up or cool down procedures.

SUMMARY OF THE INVENTION

A steam turbine having a thermal stress reduction system includes a rotor shaft in which a rotor bore (or hollowed out chamber) is disposed along the longitudinal axis of the shaft and a rotor-warming steam system coupled to the rotor bore so as to introduce steam in the rotor bore via a bore steam supply apparatus. The bore steam supply apparatus may comprise a radial steam supply device in which steam is introduced via a steam supply collar coupled to the rotor shaft (or core) and steam supply channels disposed in the rotor core for passing the steam from the steam supply collar to the rotor bore; alternatively, an axial steam supply device can be used which comprises an steam supply tube coaxially disposed within the rotor bore.

The surface of the rotor core that comprises the boundary of the rotor bore is typically grooved so that condensate from the warming steam is directed to a bore condensate drain apparatus coupled to the rotor bore. The grooves are typically rifled, that is, have a spiral pitch orientation so that as the rotor shaft turns during the warm-up process the condensate is propelled by the rotational forces along the grooves to the condensate drain apparatus.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

A steam plant 100 used in the generation of electricity commonly comprises a steam generator 110 coupled via steam piping 120 to deliver steam to a steam turbine 130, which in turn is mechanically coupled to turn an electrical generator (not shown). In steam generator 110 water is converted to steam by heat from a thermal energy source such as an oil or coal-fired boiler, a nuclear reactor, or a gas turbine. The steam passes from steam generator 110 through steam. piping 120 so as to be directed to components in steam plant 100, such as turbine 130, in which energy in the steam is extracted. In operation, steam that has passed through turbine components may be exhausted to a condenser (not shown) or supplied to an industrial process in cogeneration applications. The steam admitted to the turbine for purposes of warming the turbine prior to operation, however, typically condenses on the cold turbine components. The condensed steam used in the warming process is removed via drains coupled to components so as to prevent liquid from accumulating near moving parts of the turbine.

Figure 1:
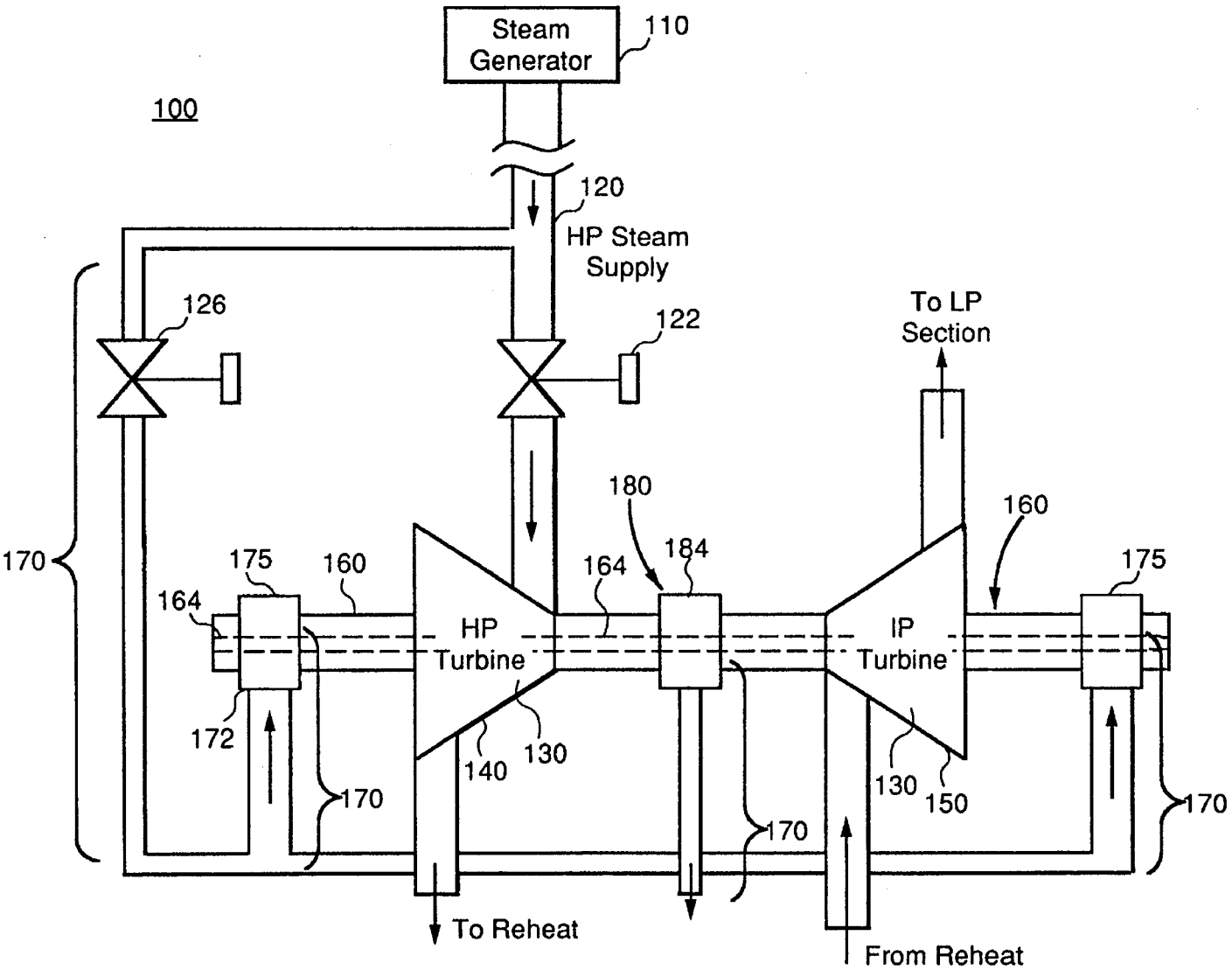
FIG. 1 is a schematic representation of a steam plant having a rapid warm-up turbine in accordance with this invention.

Steam piping 120 comprises a main control valve 122 for admitting steam to turbine 130, and a bore flow control valve 126. As illustrated in FIG. 1, steam turbine 130 comprises a high pressure turbine section 140 and an intermediate pressure (also referred to as the reheat section) turbine 150. The turbine may further have a low pressure turbine section (not shown); each of these turbine sections is typically mounted on a common turbine shaft (or rotor) 160. After a shutdown period when turbine components have cooled from their normal operating temperatures, a deliberate warmup procedure must be followed to avoid excess stress on turbine components. In particular, care must be taken to not cause stress-induced damage to the large and finely machined rotor of the turbine.

Figure 2:
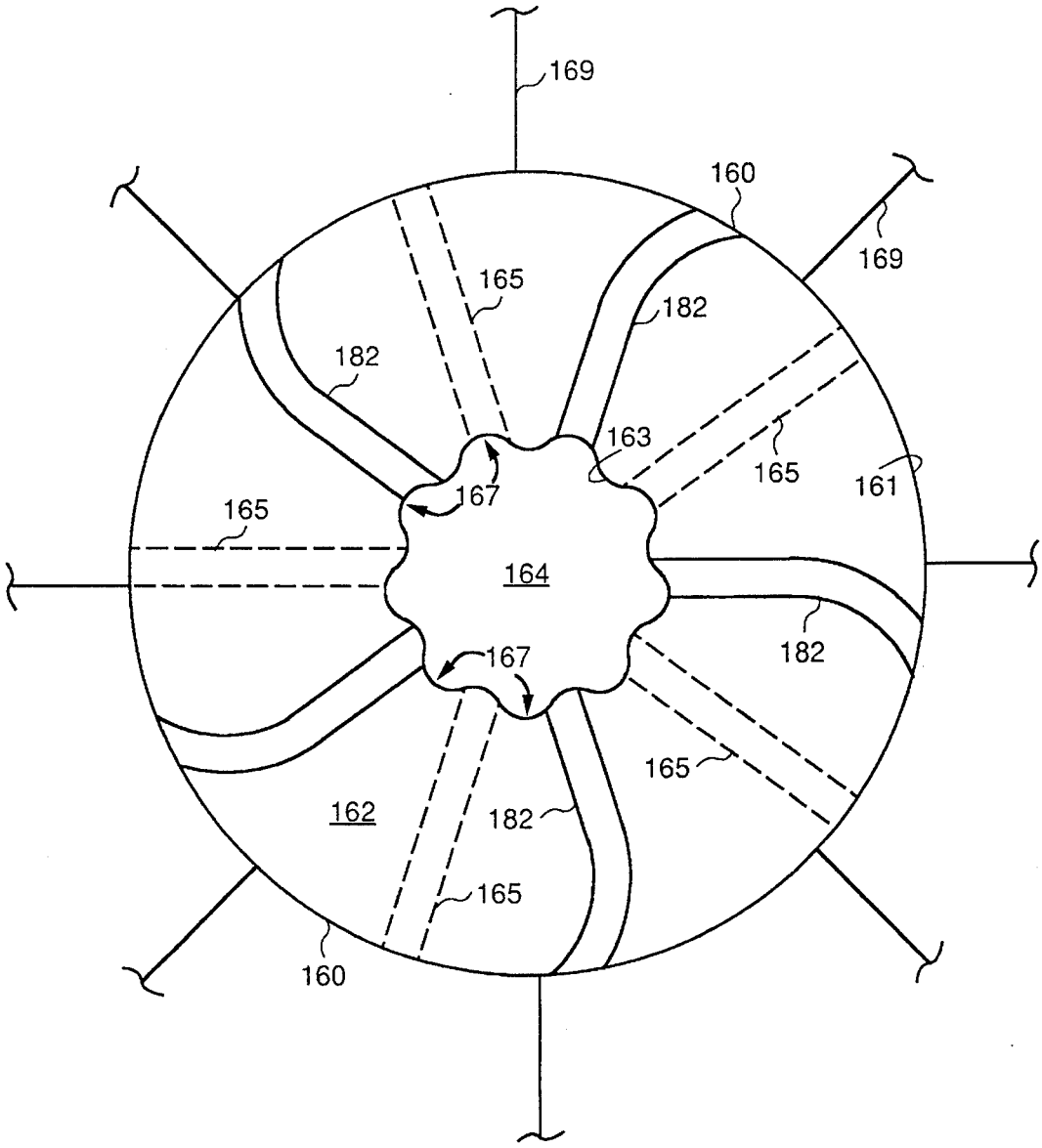
FIG. 2 is a radial cross-sectional representation of a turbine shaft in accordance with one embodiment of this invention.

A cross sectional view of turbine rotor 160 is presented in FIG. 2; rotor 160 comprises a rotor core 162 of metal (such as forged steel). A plurality of steam buckets 169 are attached to an exterior (or outer) surface 161 of rotor core 162. Rotor shaft 160 further has a chamber (or hollowed-out portion) within the shaft along the longitudinal axis of shaft; this chamber region comprises a rotor bore 164, the boundaries of which are the interior (or inner) surface 163 of rotor core 162. This hollowed-out region of rotor has commonly been formed in turbine rotors to remove the most likely source of forging defects and void regions (as most impurities tend to collect in the center of the rotor during the forging process); further the bore region provides access for inspection equipment during the manufacturing and installation process. The hollowed out region of course also reduces the weight of the shaft. In the typical conventional turbine, the rotor bore is a smooth-sided cylindrical void space within the rotor shaft that is capped on the ends so that it is hermetically sealed to avoid the infiltration of contaminants.

In accordance with this invention, rapid warming turbine 130 further comprises a rotor-stress reducing steam system 170 coupled to rotor bore 164 so as to introduce steam into the rotor bore. As illustrated in FIG. 1, rotor-stress reducing steam system 170 receives steam from steam piping 120 via bore flow control valve 126 and the warming steam (as used herein, "warming steam" and the like refers to steam available during plant startup that is reduced (if necessary) to pressures appropriate for its selective application to areas within the turbine assembly to provide warming of the turbine components; similarly, in a cool-down operation steam at appropriate temperatures and pressures can be used to minimize thermal stress in the cool-down operation) is directed to a bore steam supply apparatus 175 that provides for the passage of the steam into rotor bore 164.

Bore steam supply apparatus 175 illustrated in FIG. 1 is a radial steam supply device, that is, the steam supply device is adapted so that steam is introduced radially from exterior surface 161 of rotor core 162 into rotor bore 164. Radial steam supply device 175 typically comprises a collar 172 that is disposed around the exterior surface of rotor shaft 160 and is coupled to bore flow control valve 126 to receive warming steam therefrom. Collar 172 further comprises steam seals (not separately shown) that provide a substantially sealed environment between collar 172 and the surface of shaft 160 over which the collar is disposed. As illustrated in FIG. 2, rotor shaft 160 comprises at least one and typically a plurality of steam supply channels 165 (shown in phantom in FIG. 2) disposed with a selected spacing (typically equidistant from one another) in rotor core 162 so as to allow steam to pass from collar 172 into rotor bore 162. Rotor bore 164 typically has a diameter in the range of 10% to 40% of the rotor shaft outer diameter. By way of example and not limitation, in a turbine shaft 150 having a diameter of about 30 inches, with a bore 164 diameter in the range of about 3 inches, eight steam supply channels 165 each having a diameter in the range of about ½ inch can be used to provide a steam flow in the range of 3500 Ibm/hr to the rotor bore for preheating the turbine (assuming a steam pressure differential in the range of about 100 psia between the rotor bore and rotor shaft outer surface. Factors that are considered in determining the placement, size, and arrangement of the steam supply channels include turbine rotational speed, required bore flow (e.g., Ibm/hr of steam flow), tolerance to mechanical stress on the shaft, and geometrical constraints such as access to the shaft and location relative to other turbine components such as steam seals, bearings, and the like.

Steam that is supplied to rotor bore 164 serves to warm rotor core 162 from the interior of rotor shaft 160, resulting in condensation of the steam within rotor bore 164. Rotor-warming steam system 170 further comprises a bore-condensate drain apparatus 180 coupled to rotor bore 164 and disposed to remove condensate from the rotor bore. Bore-condensate drain apparatus 180 commonly comprises a plurality of drain channels 182 radially disposed in rotor core 162 between rotor bore 164 and outer surface 161 of rotor core 162. "Radially disposed", as used herein, refers to the channel providing communication between interior surface 163 and exterior surface 161 of rotor core 162; such a channel may be oriented straight along the radius of core 162, or alternatively, may have a curved (or angled) shape to facilitate the expulsion of condensate as the shaft rotates during the warm-up cycle of the turbine. A condensate collection collar 184 (FIG. 1) is typically disposed around rotor shaft 160 in the vicinity of drain channels 182 so as to collect the condensate expelled from rotor bore 164 and direct the condensate to a drain system (not shown). To assist with the process of draining rotor bore 164 of condensate and admission of warming steam, condensate collection collar 184 is typically coupled to the condenser system for the turbine so as to lower the pressure in rotor bore 164.

In accordance with this invention, rotor bore 164 typically is grooved, that is, interior surface 163 of rotor core 162 (that is, the surface that defines rotor bore 164) comprises a plurality of grooves 167. Grooves 167 typically have a cross-sectional profile (taken perpendicular to the longitudinal axis of rotor core 162) that is curved (or undulating); the use of curves in interior surface 163 reduces the likelihood of stress risers in rotor core 162 (which might more commonly appear if non-curved surfaces were used to form grooves 167). Grooves 167 serve to collect condensate from the warming steam applied to rotor bore 164 and direct it to bore-condensate drain apparatus 180.

Rotor bore 164 is typically further rifled, that is, grooves 167 in rotor bore 164 are spiraled along the (longitudinal) length of rotor bore so that the rotational forces existent as the turbine rotates (e.g., centrifugal force) during the warm-up period serve to direct the condensate towards bore-condensate drain apparatus 180. Grooves 167 in rotor bore are disposed to have a degree of rifling (that is, a spiral pattern often referred to as pitch) to provide a desirable condensate flow towards bore-condensate drain apparatus 180. Rifled rotor bore 164 having grooves 167 thus provides a passive means of removing the condensate from rotor bore 164; as the rotor spins, the condensate is evenly distributed around the circumference of rotor bore 164 (that is, interior surface 163 of rotor core 162) by centrifugal force and surface tension and the rotation further forces the condensate axially along the grooves toward the drain. The pitch of the grooves is selected (in the manufacturing process) to force flow of the condensate along the shaft in the direction of the drain point. Thus, grooves 167 at opposite ends of rotor shaft 160 may have a different (e.g., reversed) pitch in order to direct condensate to a centrally located drain connection 184, as is illustrated in FIG. 1. Groove depth, spacing, and geometry (or surface profile) is typically designed for each turbine rotor shaft 160 to optimize effective condensate transfer with mechanical stresses on the rotor shaft.

Figure 3:
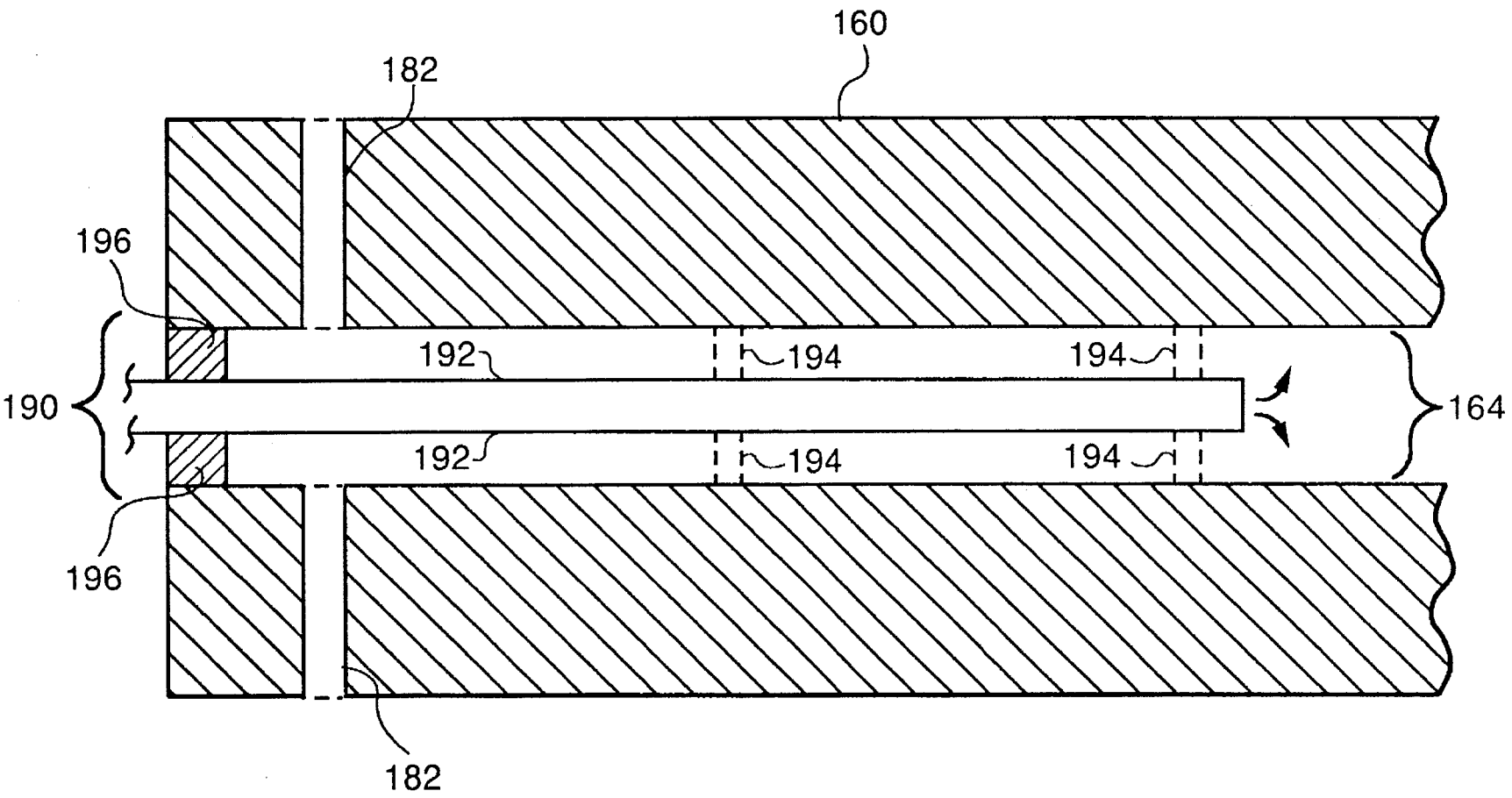
FIG. 3 is an axial cross,sectional representation of a turbine shaft in accordance with another embodiment of the present invention.

Radial steam supply device 175 and radial drain channels 182 are typically used in turbine arrangements in which the end of rotor shaft 160 is not accessible, such as in installations in which other equipment (such as generators, gas turbines, or the like) are coupled to the ends of the shaft. Alternatively, in installations in which access can be had to the end of turbine shaft 160, an axial steam supply device 190 (FIG. 3) is commonly used to supply steam to rotor bore 164. Axial steam supply device 190 typically comprises a steam supply tube 192 disposed coaxially within rotor bore 164; one end of steam supply tube 192 is coupled to receive steam from the bore flow control valve and the other end is disposed within rotor bore 164 so as to discharge the warming steam into the rotor bore. Alternatively, steam supply tube 192 does not extend into rotor bore 164 but rather is disposed to inject the warming steam into the axial end of rotor bore 164. Shaft seals 196 are typically disposed around shaft 160 so as to support the end of rotor bore 164 at the point where steam tube 192 penetrates shaft 160.

Steam supply tube 192 may further be perforated along at least some portion of its length so that steam is discharged into rotor bore 164 from steam supply tube 192 at points other that the end of the tube. Steam supply tube is typically supported in rotor bore 164 by one or more perforated stanchions 194 disposed between steam supply tube 192 and interior surface 163 of rotor core 162. Stanchions 194 are perforated to allow the passage of warming steam and condensate therethrough. Commonly the interior of steam supply tube 192 is rifled (as described above with respect to rotor bore 164) so that any condensate formed within steam supply tube 192 is directed out of the tube into rotor bore 164 to be removed by bore-condensate drain apparatus 180.

Axial steam supply device 190 is adapted for use with radially-oriented condensate drain channels, or, alternatively, with a bore-condensate drain apparatus 180 in which the condensate is directed along an axial path into shaft seals 196 for drainage.

In operation, pre-warming turbine 130 includes introducing steam into the blade area of typically the HP blade section through control of steam valve 122 and introducing steam into rotor bore 164 through control of bore flow control valve 126. Heating of rotor shaft 160 is thus accomplished by the presence of warming steam on both exterior surface 161 and interior surface 163 of rotor core 162. The effective rotor core thickness, for purposes of prewarming, is thus reduced by about 50% as the rotor core can be warmed from both sides.

The turbine components of the present invention providing reduced thermal stress are similarly readily used in cool-down operations so as to admit "cooling steam", that is, steam at lower temperature/pressures than the temperature of the rotor shaft so as to extract heat from the rotor core, and thus provide reduced thermal stress across rotor core 162 when the turbine is being cooled.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A steam turbine with a thermal stress reduction system, the turbine comprising:

a rotor core having a rotor bore disposed therein, said rotor bore being disposed along the longitudinal axis of said rotor core and having a boundary defined by an interior surface of said rotor core; and a rotor-stress reducing steam system coupled to said rotor bore so as to introduce steam into said rotor bore via a bore steam supply apparatus.

2. The turbine of claim 1 wherein said rotor-stress reducing steam system further comprises a bore-condensate drain apparatus coupled to said rotor bore.

3. The turbine of claim 2 wherein said interior surface of said rotor core comprising said boundary of said rotor bore is grooved.

4. The turbine of claim 3 wherein said interior surface comprising the boundary of said rotor bore is rifled.

5. The turbine of claim 4 wherein the rifled grooves of said interior surface comprising the boundary of said rotor bore are disposed so as to direct condensed steam to a coupling point between said rotor bore and said-bore-condensate drain apparatus.

6. The turbine of claim 3 wherein the grooves in the surface of said rotor core comprising the boundary of said rotor bore comprise curved surfaces.

7. The turbine of claim 2 wherein said bore steam supply apparatus comprises a radial steam supply device.

8. The turbine of claim 2 wherein said radial steam supply device comprises a steam supply collar coupled to said rotor core and at least one steam supply channel disposed in said rotor core so as to extend between said steam supply collar and said rotor bore.

9. The turbine of claim 2 wherein said bore steam supply apparatus comprises an axial steam supply device.

10. The turbine-of claim 9 wherein said axial steam supply device comprises a steam supply tube coaxially disposed within said rotor bore.

11. The turbine of claim 2 wherein said bore-condensate drain apparatus comprises a plurality of condensate drain channels disposed radially in said rotor core.

12. The turbine of claim 2 wherein said bore-condensate drain apparatus comprises a condensate collection collar disposed to receive condensate from said rotor bore.

* * * * *